US006544048B2

(12) United States Patent
Harting et al.

(10) Patent No.: US 6,544,048 B2
(45) Date of Patent: Apr. 8, 2003

(54) PLUG CONNECTOR

(75) Inventors: Dietmar Harting, Espelkamp (DE); Günter Pape, Enger (DE); Manfred Berghorn, Stolzenau (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/737,984

(22) Filed: Dec. 15, 2000

(65) Prior Publication Data

US 2002/0137370 A1 Sep. 26, 2002

(30) Foreign Application Priority Data

Dec. 16, 1999 (DE) ..... 199 60 857

(51) Int. Cl.[7] ..... H01R 5/56
(52) U.S. Cl. ..... 439/101; 439/602
(58) Field of Search ..... 439/79, 101, 108, 439/607, 66, 14, 610, 606, 609, 59

(56) References Cited

U.S. PATENT DOCUMENTS 4,632,476 A * 12/1986 Schell ..... 439/14
5,295,867 A * 3/1994 Bethurum ..... 439/607
5,597,313 A * 1/1997 Lindeman ..... 439/66
5,984,698 A * 11/1999 Hirata ..... 439/101

FOREIGN PATENT DOCUMENTS

| | | |
|---|---|---|
| DE | 39 26 802 | 2/1990 |
| DE | 196 04 432 | 8/1997 |
| EP | 1 020 956 A1 | 7/2000 |
| GB | 2 222 917 A | 3/1990 |

OTHER PUBLICATIONS

Cover page containing an abstract of Great Britain Patent 2 222 917 A, filed Aug. 7, 1989, corresponding to German Patent No. DE 39 26 802.

* cited by examiner

*Primary Examiner*—Renee Luebke
*Assistant Examiner*—Phuongchi Nguyen
(74) *Attorney, Agent, or Firm*—Cook, Alex, McFarron, Manzo, Cummings & Mehler, Ltd.

(57) ABSTRACT

A plug connector for mounting on a circuit board is proposed, having a carrier body (10), at least one surface mounting contact member (20) disposed in the carrier body and at least one pass-through mounting contact member (38) which is also disposed in the carrier body. In this manner; a good mechanical connection between the carrier body and the circuit board is achieved due to the pass-through mounting contact member, while the surface mounting contact member enables quick signal transmission towards the conductor track.

3 Claims, 2 Drawing Sheets

PLUG CONNECTOR

BACKGROUND OF THE INVENTION

The invention relates to a plug connector for mounting on a circuit board and having contact members which are to be connected with a conductor track of the circuit board by means of a soldering point.

There are known plug connectors whose contact members are formed as pass-through mounting contact members, that is are plugged into a bore through the conductor track of the circuit board. This results in high mechanical strength of the connection between the circuit board and the contact member of the plug connector.

There are also known plug connectors whose contact members are formed as surface mounting contact members, that is are soldered onto the conductor track. The resulting soldering point merely offers a comparatively low mechanical strength, more particularly under shear strains. However, a higher signal transmission velocity between the contact member and the conductor track may be achieved.

BRIEF SUMMARY OF THE INVENTION

It is the object underlying the invention to provide a plug connector which enables a connection between the circuit board and the plug connector with high mechanical strength along with high signal transmission velocity.

This object is met by a plug connector for mounting on a circuit board, having a carrier body, at least one surface mounting contact member disposed in the carrier body and at least one pass-through mounting contact member which is also disposed in the carrier body. In this plug connector, the pass-through mounting contact member ensures good mechanical connection of the carrier body with the circuit board while the surface mounting contact member enables quick signal transmission to the conductor track.

The pass through mounting contact member is preferably a ground contact. This configuration is advantageous since the lower signal transmission speed has almost no effect. Generally, the pass-through mounting contact member may also be used for signal transmission with signals having a low frequency.

Preferably, four surface mounting contact members and one pass-through mounting contact member are provided, the surface mounting contact members being disposed in two groups separated from each other by the pass-through mounting contact member. In this configuration, the pass-through mounting contact member serves as a shielding between the two groups of surface mounting contact members which are used for signal transmission so that there results high channel separation.

According to a preferred embodiment of the invention, the surface mounting contact member is provided with a connecting region on which there is disposed a connecting member which is displaceable relative to the connecting region. This configuration makes it possible to keep to the thickness of the solder pad between the surface mounting contact member and the conductor track, which is critical in surface mounting technology, in an especially simple manner. Other than with conventional surface mounting contact members which must be manufactured with especially narrow tolerances in order to obtain the required spacing of about 0.1 mm between the contact member and the conductor track after the plug connector has been put onto the circuit board, the required spacing results by itself in this embodiment as the connecting member is displaced correspondingly far on the connecting region.

Advantageous configurations of the invention may be taken from the sub-claims.

BRIEF DESCRIPTION OF THE DRAWINGS

In the following, the invention will be described with reference to various embodiments represented in the enclosed drawings. Therein.

DETAILED DESCRIPTION OF THE INVENTION

Figure 1:
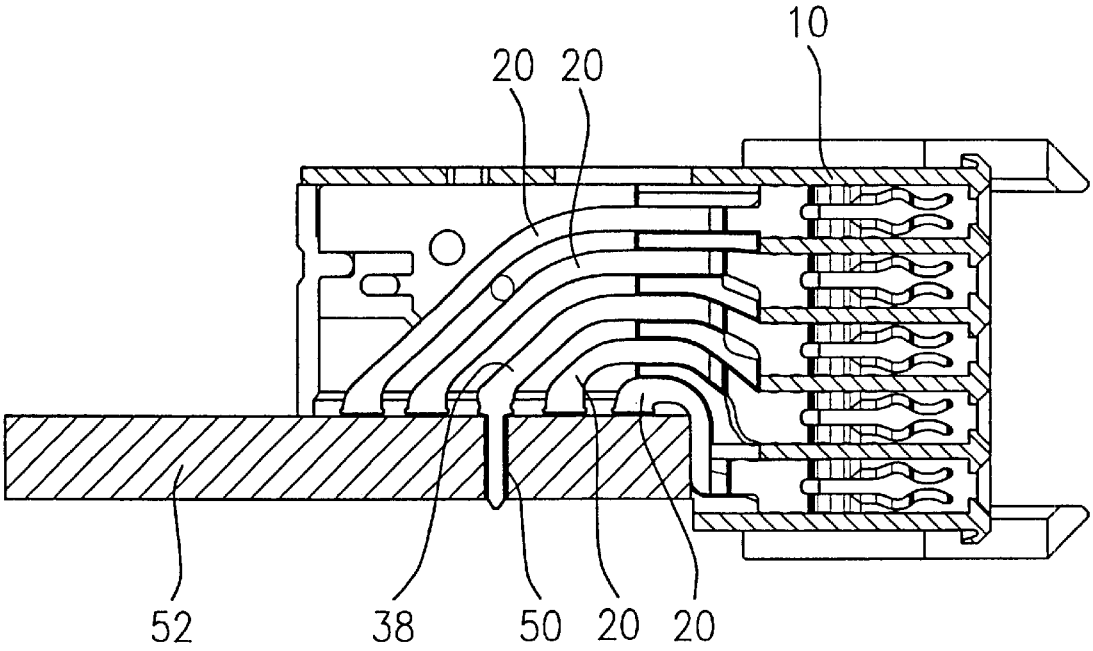
FIG. 1 is a sectional view of a plug connector according to a first embodiment of the invention.

FIG. 1 shows a plug connector according to a first embodiment of the invention. This concerns an angled multiple-contact strip since the individual contacts are each angled by 90° and configured as contact springs on the connecting side of the plug connector. Correspondingly, the complementary plug connector, which is plugged into the shown plug connector, is a blade-contact strip. Of course, the embodiment shown may also be formed as a blade-contact strip. In any case, the plug connector comprises a plurality of contacts which are disposed in several adjacent columns. Only one of these columns can be seen in the sectional representation of FIG. 1.

The shown plug connector comprises an insulating carrier body 10 in which two groups of two surface mounting contact members 20 are disposed, as well as a pass-through mounting contact member 38 which separates the two groups of surface mounting contact members 20 from each other. The pass-through mounting contact member 38 may be connected with a ground conductor and serves as a shielding between the two groups of surface mounting contact members, 20 which serve for signal transmission.

During mounting, the plug connector is inserted with its pass-through mounting contact member in an opening 50 of a circuit board 52 onto which a solder paste had previously been applied at the corresponding locations. In this condition, the plug connector is prefixed. Subsequently, the contact members are soldered so that the desired electrical connection with the conductor tracks is achieved.

Figure 2:
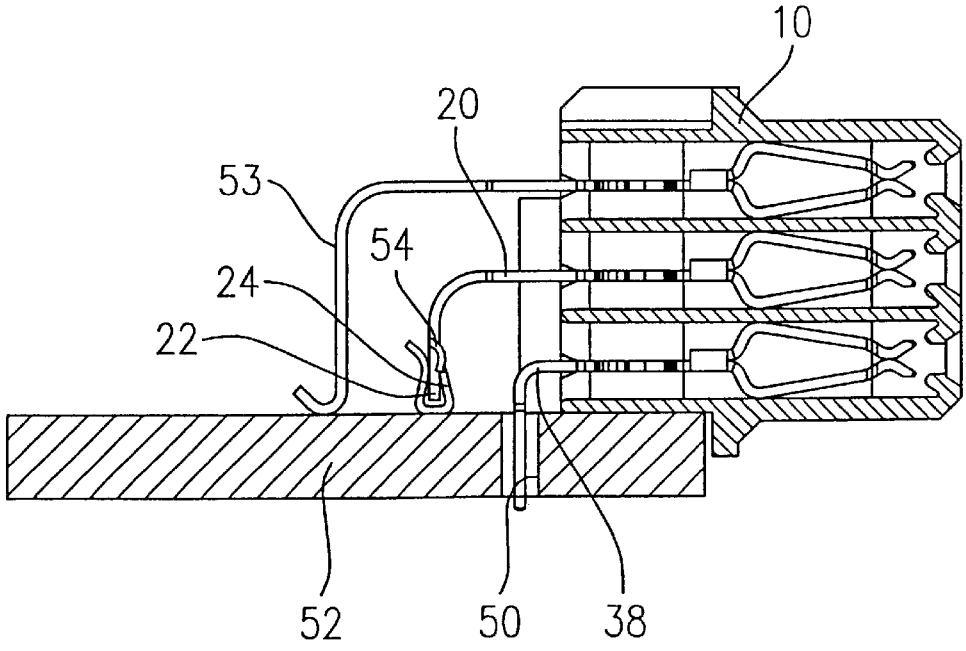
FIG. 2 is a sectional view of a plug connector according to a second embodiment of the invention.

FIG. 2 shows a plug connector according to a second embodiment of the invention. In this embodiment, three contact members are used, namely an inner pass-through mounting contact member 38 which engages an opening 50 of a circuit board 52, a central surface mounting contact member 20 which is provided with a connecting region 22 on which a connecting member 24 is disposed, and an outer surface mounting contact member 53 which is provided, at its end facing the circuit board, with a bend which rests on the circuit board and may be connected there with a corresponding conductor track in a surface mounting technique.

Figure 3:
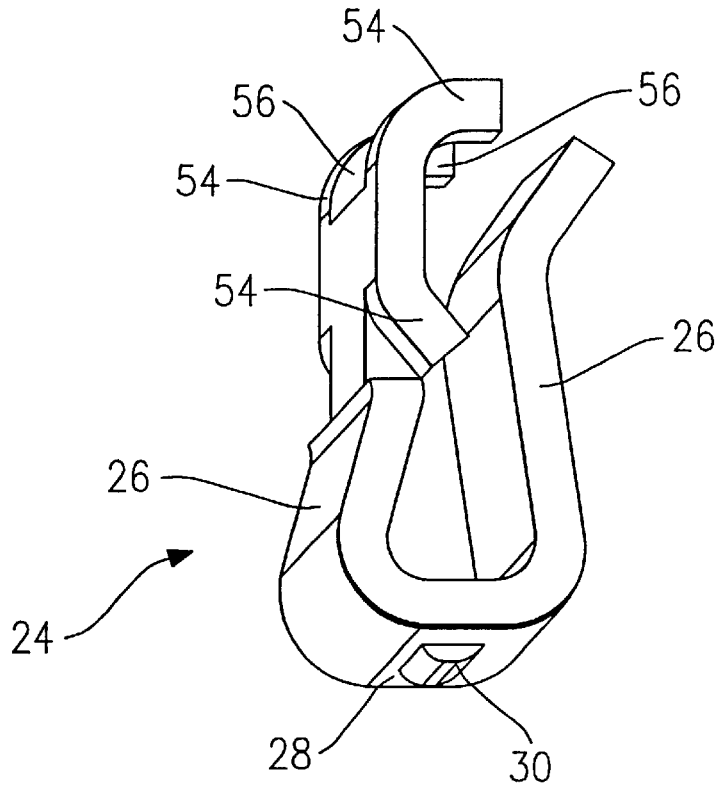
FIG. 3 is an isometric view of a connecting member used with the plug connector shown in FIG. 2.

FIG. 3 shows the connecting member 24 which is used in the surface mounting contact members 20 of the plug connector shown in FIG. 2. The connecting member 24 is formed as a resilient clamp with two legs 26 being connected to each other by means of a bottom 28. On the bottom, there is provided, on the side facing away from the connecting region 22, a spacer 30 which is configured as a stamping in such a manner that a comparatively pointed apex is formed.

The connecting member 24 is pushed onto the connecting region 22 of the surface mounting contact member 20 and is fixed thereon by the frictional force resulting from the acting clamping force. In order to prevent the connecting member from slipping off the connecting region 22 which has a rectangular cross-section, bent-off noses 54 are provided on one of the legs 26 of the connecting member 24, whose opposite surfaces act as guide surfaces 56. These may engage the narrow outer surfaces of the connecting regions 22 and prevent the connecting member 24 from excessively tilting or even slipping off.

Figure 4:
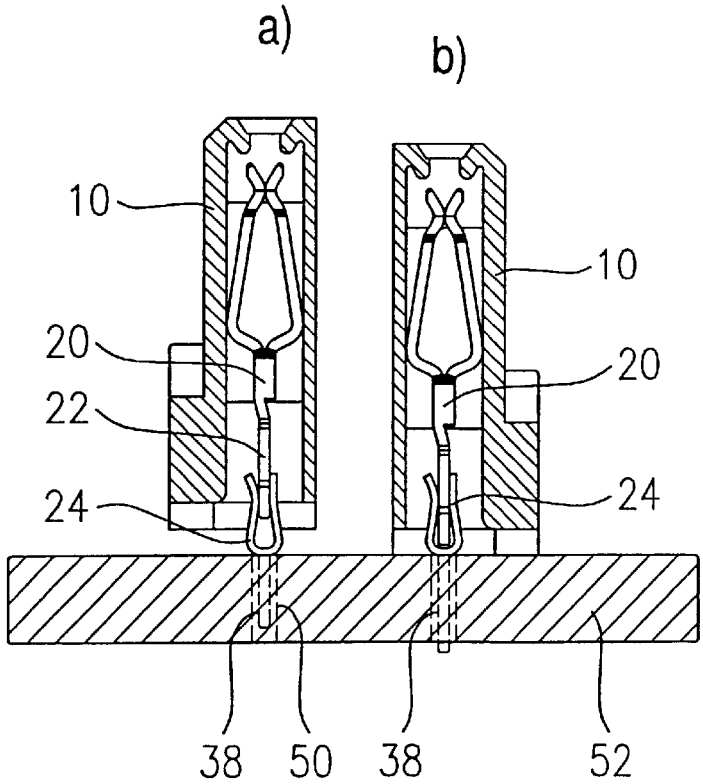
FIGS. 4*a* and 4*b* are each schematic sectional views of a plug connector according to a further embodiment in a condition before and after mounting on a circuit board.

In the following, the mounting of a further embodiment of a plug connector on a circuit board will be described upon reference to FIG. 4. This embodiment concerns a straight multiple-contact strip, surface mounting contact members and pass-through mounting contact members being provided one behind the other in a single row.

First, the circuit board is coated with a solder paste at the locations which are provided for connection with the contact members. Subsequently, the plug connector is put onto the circuit board, the pass-through mounting contact member penetrating into the corresponding opening of the circuit board. The mounting position of contact members 24 shown in FIG. 4*a* is selected such that the spacer 30 bears against the circuit board before the pass-through mounting contact member 38 is completely pushed into the circuit board. During the process of putting the plug connector onto the circuit board, the connecting member 24 immerses into the previously applied solder paste, the spacer 30 reliably forcing away and penetrating the solder paste with its apex, so that it rests on the circuit board. This ensures that the bottom 28 in all the remaining regions has a predetermined spacing from the circuit board, which is given by the height of the spacer, preferably is 0.1 mm, and is completely filled with solder paste. In the course of putting on, there also results a relative movement between the connecting member 24 and the connecting region 22, whereby the legs 26 of the connecting member formed as a clamp are pushed further onto connecting region 22. This condition, in which the electrical connection between the connecting member 24 and the connecting region 22 as well as the optimum spacing between the bottom of the connecting member and the conductor track are ensured independently of the respectively existing tolerances, is shown in FIG. 4*b*.

As soon as the plug connector is correctly put onto the circuit board, the surface mounting contact members may be soldered, a reliable soldering being ensured due to the precisely kept spacing between the bottom of the connecting member 24 and the circuit board. This spacing between the bottom 28 of the connecting member 24 and the circuit board is not influenced by tolerances of the plug connector or by an uneven circuit board surface since possible tolerances are compensated in that the contact member is pushed onto the connecting region 22 of the surface mounting contact member in differing lengths.

What is claimed is:

1. A plug connector for mounting on a circuit board and including at least one carrier body (10), a plurality of surface mounting contact members (20) disposed in the carrier body, at least one grounded pass-through mounting contact member (38) which is disposed in the carrier body, characterized in that at least one of the plurality of surface mounting contact members (20) includes a connecting region (22), and at least one connecting member (24) for separately receiving one connecting region (22) therein and having surfaces which prevent lateral movement of the connecting region (22) relative to the connecting member (24), the connecting member (24) being vertically displaceable relative to the connecting region (22) to accommodate tolerance differences in the printed circuit board and the plug connector the connecting member (24) being in electrical engagement with the circuit board and at least one of the plurality of surface mounting contact members (20) to provide for high frequency signal transmission therebetween such that at least one of the plurality of surface mounting contact members is in electrical engagement with the circuit board.

2. A plug connector including a mounting side for mounting on a circuit board and a connecting side for connecting to a complementary connector, the plug connector including at least one carrier body (10), a plurality of surface mounting contact members (20) disposed in the carrier body, at least one grounded pass-through mounting contact member (38) disposed in the carrier body, and a connecting member (24) being in electrical engagement with the circuit board and including two legs (26) and two bent-off noses (54) which project upwardly from at least one of the legs (26), the bent-off noses (54) having guiding surfaces (56) which define one set of spaced opposed inner surfaces, the legs (26) defining another set of spaced opposed inner surfaces, at least one of the plurality of surface mounting contact members (20) includes a connecting region (22), the connecting member (24) receiving the connecting region (22) therein in an electrical engagement so as to provide an electrical connection between the circuit board and at least one of the plurality of surface mounting contact members, the connecting region (22) being sandwiched between the two legs (26) and between the two bent-off noses (54) such that the two legs (26) engage a first set of opposed outer surfaces of the connection region (22) and the guiding surfaces (56) engage a second set of opposed outer surfaces of the connecting region (22) where the first set of opposed outer surfaces is transversely located in relation to the second set of opposed outer surfaces so as to prevent lateral movement of the connecting region (22) relative to the connecting member (24).

3. The plug connector of claim 2 wherein the connecting member (24) includes a spacer (30) formed as an apex on a bottom (28) of the connecting member which faces away from the connecting region (22) such that a predetermined space remains between the circuit board and the bottom (28) of the connecting member when the plug connector is mounted to the circuit board thus the connecting member (24) is directly mounted to the surface of the circuit board.

* * * * *